US009939762B2

(12) United States Patent
Kakitani et al.

(10) Patent No.: US 9,939,762 B2
(45) Date of Patent: Apr. 10, 2018

(54) IMAGE FORMING APPARATUS AND SHEET FEEDING DEVICE

(71) Applicant: CANON KABUSHIKI KAISHA, Tokyo (JP)

(72) Inventors: Masaki Kakitani, Abiko (JP); Kenichi Manabe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/416,530

(22) Filed: Jan. 26, 2017

(65) Prior Publication Data

US 2017/0227898 A1 Aug. 10, 2017

(30) Foreign Application Priority Data

Feb. 9, 2016 (JP) ..... 2016-023046
Jul. 11, 2016 (JP) ..... 2016-137176

(51) Int. Cl.
*G03G 21/00* (2006.01)
*G03G 15/20* (2006.01)
(Continued)

(52) U.S. Cl.
CPC ..... *G03G 15/2028* (2013.01); *G03G 15/6541* (2013.01); *G03G 15/6576* (2013.01);
(Continued)

(58) Field of Classification Search
CPC ..... G03G 21/1633; G03G 21/1638; G03G 2221/1675
See application file for complete search history.

(56) References Cited

U.S. PATENT DOCUMENTS 6,658,218 B2 * 12/2003 Krolczyk ..... B65H 43/00 399/16
7,092,646 B2 * 8/2006 Schroath ..... G03G 15/70 399/16
(Continued)

FOREIGN PATENT DOCUMENTS

JP 2003-241454 A 8/2003
JP 2006-350223 A 12/2006
(Continued)

OTHER PUBLICATIONS

European Search Report issued in corresponding European Application No. 17153193.2 dated Jun. 7, 2017.
(Continued)

*Primary Examiner* — Ryan Walsh
(74) *Attorney, Agent, or Firm* — Fitzpatrick, Cella, Harper & Scinto

(57) ABSTRACT

An image forming apparatus includes a main assembly; an image forming portion for forming an image on a sheet; an openable member rotatably supported by the main assembly; a first feeding guide provided on the openable member; a second feeding guide provided in the main assembly, wherein when the openable member is closed, a sheet feeding path for feeding the sheet is formed by the first and second feeding guides; a hole provided in the first feeding guide; and an illumination device, provided on the openable member, for illuminating at least a part of the second feeding guide through the hole when the openable member is open.

18 Claims, 10 Drawing Sheets

(51) Int. Cl.
*G03G 15/00* (2006.01)
*G03G 21/16* (2006.01)

(52) U.S. Cl.
CPC ..... *G03G 21/1633* (2013.01); *G03G 21/1638* (2013.01); *G03G 2215/00548* (2013.01); *G03G 2221/1675* (2013.01)

(56) References Cited

U.S. PATENT DOCUMENTS

| | | | | |
|---|---|---|---|---|
| 7,334,786 | B2 * | 2/2008 | Shinga | B65H 1/266 271/145 |
| 7,341,247 | B2 * | 3/2008 | Hirata | B65H 37/00 270/58.07 |
| 8,777,472 | B2 * | 7/2014 | Okada | G03G 15/5016 362/551 |
| 9,442,450 | B2 | 9/2016 | Sato et al. | |
| 2007/0014580 | A1 | 1/2007 | Woo | |
| 2013/0302044 | A1 * | 11/2013 | Yoshioka | G03G 21/1695 399/21 |
| 2014/0334834 | A1 * | 11/2014 | Katsuyama | G03G 15/70 399/21 |
| 2014/0369046 | A1 * | 12/2014 | Andoh | B41J 29/42 362/282 |
| 2016/0103411 | A1 | 4/2016 | Sato et al. | |
| 2016/0378048 | A1 * | 12/2016 | Sugawara | G03G 15/70 399/21 |
| 2017/0131679 | A1 * | 5/2017 | Koyanagi | G03G 15/70 |
| 2017/0227917 | A1 * | 8/2017 | Manabe | G03G 21/1638 |

FOREIGN PATENT DOCUMENTS

| | | | |
|---|---|---|---|
| JP | 2009-179441 | A | 8/2009 |
| JP | 2011-011838 | A | 1/2011 |

OTHER PUBLICATIONS

Copending, unpublished U.S. Appl. No. 15/422,633 to Kenichi Manabe, filed Feb. 2, 2017.

* cited by examiner

IMAGE FORMING APPARATUS AND SHEET FEEDING DEVICE

FIELD OF THE INVENTION AND RELATED ART

The present invention relates to an image forming apparatus including an openable member opened when a jam of a sheet generates.

The image forming apparatus such as a copying machine or a printer includes a sheet feeding device for feeding the sheet on which an image is to be formed by an image forming portion.

The sheet feeding device includes a reversing portion for feeding the sheet in a switchback manner as disclosed in Japanese Laid-Open Patent Application (JP-A) 2011-11838. The reversing portion includes a discharge feeding path, a reverse induction path, a switchback path, and a reverse discharge path. The discharge feeding path is a sheet feeding path for guiding the sheet, on which the image is formed, in order to discharge the sheet from the image forming apparatus. The reverse induction path is a feeding path branching from the discharge feeding path. The switchback path is a sheet feeding path in which the sheet, on which the image is formed, passed through the reverse induction path is pulled in order to turn upside down the sheet and to reverse leading and trailing ends of the sheet with respect to a (sheet) feeding direction. The reverse discharge path is a sheet feeding path, merged with the discharge feeding path, for guiding the sheet pulled in the switchback path in order to discharge the sheet from the image forming apparatus. In the case of the image forming apparatus capable of effecting both-side (double-side) image formation for forming images on the surfaces (sides) of the sheet, the sheet feeding device also includes a both-side feeding path which is a sheet feeding path in which the sheet of which leading and trailing ends with respect to the feeding direction are reversed in the switchback path at the reversing portion is fed.

Incidentally, in the case where a jam generates in the image forming apparatus, "jam clearance" for removing the sheet causing the jam is required. For that reason, an openable member is provided as a part of the image forming apparatus and the openable member is opened to expose the sheet feeding device and a (sheet) feeding member and then the sheet is removed. For example, in some cases, a rotatable door (reversing door) is provided at a side surface of the image forming apparatus where the sheet is to be discharged, in order to expose the sheet feeding path and the feeding member of the above-described reversing portion.

Further, to the image forming apparatus, a decurling unit for correcting a curled state of the sheet on which the image is formed and an option unit, for carrying out a post-processing, such as a finisher for carrying out stapling are additionally movable in some cases. When the option unit is mounted to the image forming apparatus, the option unit and the image forming apparatus are integrally used as an image forming system.

JP-A 2003-241454 discloses a constitution in which an openable door for opening a feeding path is provided with a lamp and the feeding path is illuminated with the lamp when the door is open.

However, in the case where the option unit is mounted to the image forming apparatus, an operation such as the jam clearance is not readily performed in some cases.

For example, the case where the jam generated in the above-described reversing portion in a state in which the option unit is connected with the side surface of the image forming apparatus where the sheet is to be discharged will be considered. In this case, by the influence of existence of the option unit, an opening/closing angle of the reversing door becomes small and a space (open space) for permitting the jam clearance when the reversing door is open becomes narrow. Further, in order to maintain the reversing door in an openable state or the like, elements of the option unit, such as the sheet feeding path are disposed at an upper portion of the reversing door. For that reason, the open space of the reversing door becomes dark as a shadow of the option unit and the openable member, so that viewability of the sheet stagnating in the sheet feeding path becomes worse in some cases. As a result, the jam clearance is not readily performed.

Further, in the constitution of JP-A 2003-241454, when the door is open, the lamp is uncovered in the open space by the opening of the door. For that reason, the lamp constitutes an obstacle when the stagnating sheet is removed.

SUMMARY OF THE INVENTION

The present invention provides an image forming apparatus capable of easily carrying out an operation such as jam clearance in an open space of an openable member.

According to an aspect of the present invention, there is provided an image forming apparatus comprising: a main assembly; an image forming portion for forming an image on a sheet; an openable member rotatably supported by the main assembly; a first feeding guide provided on the openable member; a second feeding guide provided in the main assembly, wherein when the openable member is closed, a sheet feeding path for feeding the sheet is formed by the first and second feeding guides; a hole provided in the first feeding guide; and an illumination device, provided on the openable member, for illuminating at least a part of the second feeding guide through the hole when the openable member is open.

Further features of the present invention will become apparent from the following description of exemplary embodiments with reference to the attached drawings.

DESCRIPTION OF THE EMBODIMENTS

An image forming apparatus and an image forming system according to the present invention will be described with reference to the drawings.

Embodiment 1

1. Image Forming System

Figure 1:
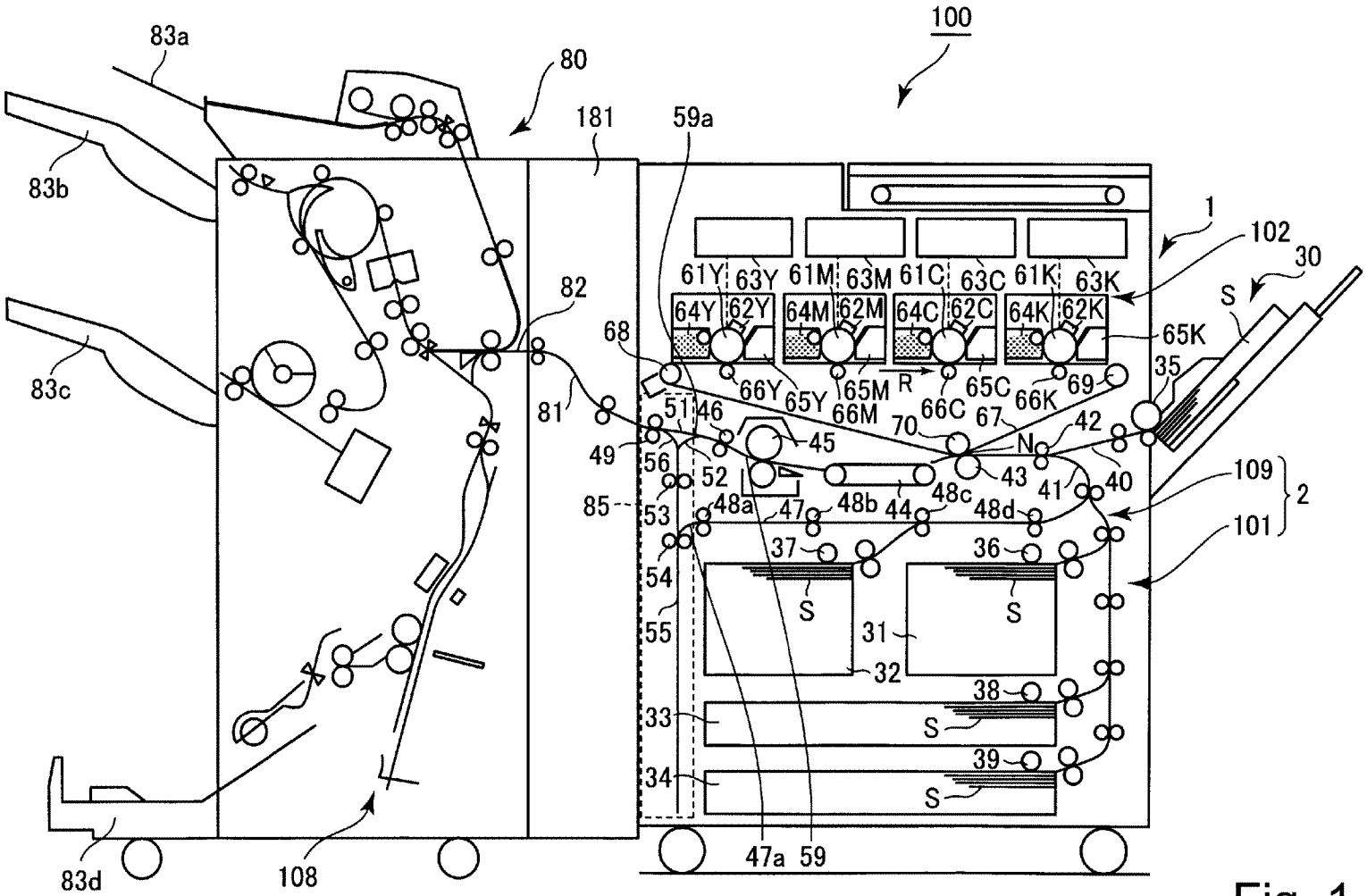
FIG. 1 is a schematic sectional view of an image forming system.
Figure 2:
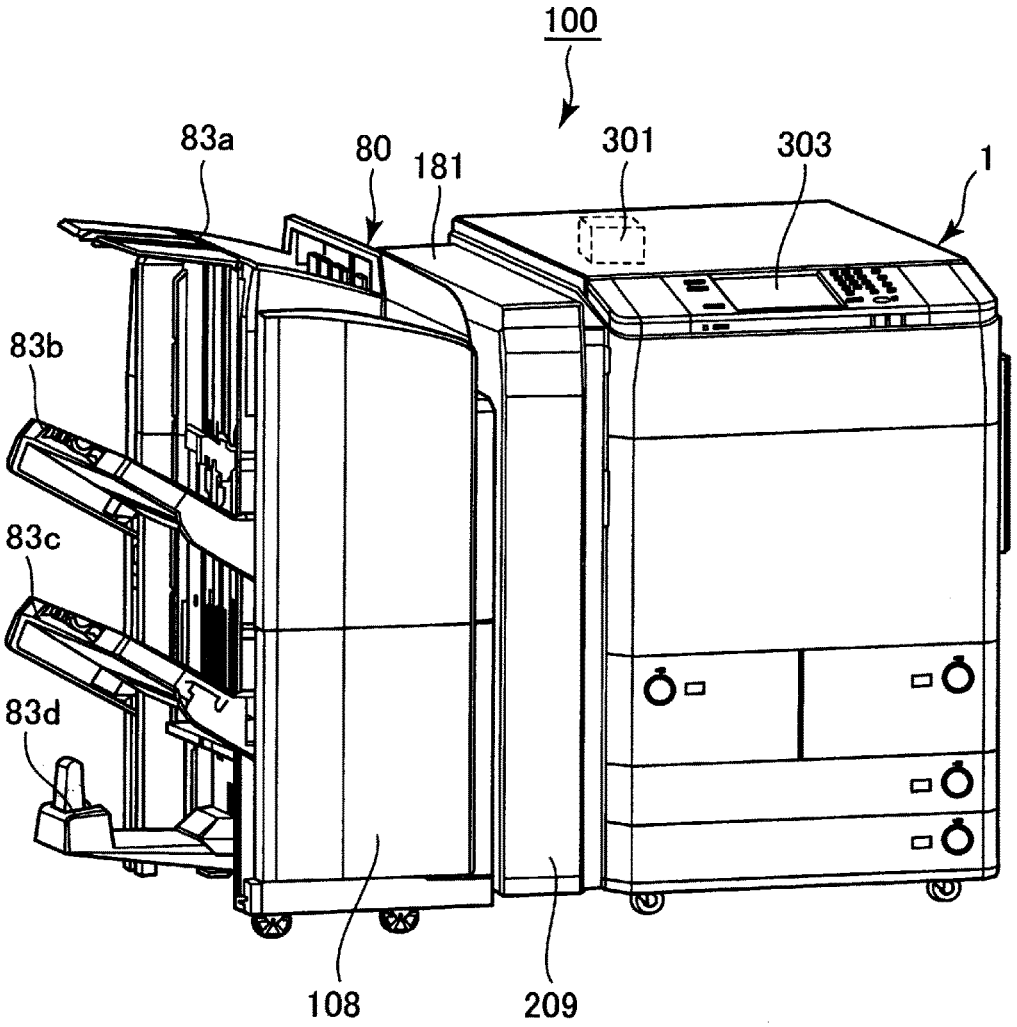
FIG. 2 is a perspective view of the image forming system.

FIG. 1 is a schematic sectional view of an image forming system 100 in this embodiment. FIG. 2 is a perspective view of the image forming system 100.

The image forming system 100 includes an image forming apparatus 1 and a finisher 80 as an option unit. In this embodiment, the image forming apparatus 1 is a color image forming apparatus using an electrophotographic type. Particularly, in this embodiment, from advantages such as compatibility with a wide variety of sheets and excellent print productivity, the image forming apparatus 1 employs an intermediary transfer tandem type in which image forming units for four colors are provided and disposed on an intermediary transfer belt. Further, in this embodiment, the finisher (post-processing device) 80 has a function of post-processing such as stapling or saddle stitch.

The image forming apparatus 1 includes a sheet feeding portion 101 for feeding a sheet (recording material, transfer material) S such as a recording sheet and a sheet feeding (conveying) portion 109 for feeding (conveying) the sheet S fed by the sheet feeding portion 101. In this embodiment, a sheet feeding device 2 is constituted by the sheet feeding portion 101 and the sheet feeding portion 109. The image forming apparatus 1 includes an image forming portion 102 for forming an image on the sheet S fed by the sheet feeding portion 109.

The sheet feeding portion 101 includes sheet accommodating portions 30-34 and sheet feeding members 35-39.

The image forming portion 102 includes photosensitive members 61 (61Y, 61M, 61C, 61K), charging devices 62 (62Y, 62M, 62C, 62K), exposure devices 63 (63Y, 63M, 63C, 63K) and developing devices 64 (64Y, 64M, 64C, 64K). Further, the image forming portion 102 includes primary transfer devices 66 (66Y, 66M, 66C, 66K) and photosensitive member cleaners 65 (65Y, 65M, 65C, 65K). Further, the image forming portion 102 includes an intermediary transfer belt 67 onto which toner images formed on the photosensitive members 61Y, 61M, 61C, 61K are primary-transferred and a secondary transfer roller 43 which is a secondary transfer device for transferring the toner images from the intermediary transfer belt 67 onto the sheet S. The intermediary transfer belt 67 is stretched by rollers as stretching rollers such as a driving roller 68, a tension roller 69 and an inner secondary transfer roller 70 and is rotationally driven (fed) in an arrow R direction (clockwise direction) indicated in FIG. 1. Further, the image forming portion 102 includes a fixing device 45 for fixing an image on the sheet S on which the toner images are transferred.

The sheet feeding portion 109 includes supply feeding paths 40, 41 which are sheet feeding paths through which the sheet S fed by the sheet feeding members 35-39 of the sheet feeding portion 101 pass. Further, the sheet feeding portion 109 includes a registration roller pair 42 for feeding the sheet S to a secondary transfer portion (secondary transfer nip) N which is a contact portion between the intermediary transfer belt 67 and the secondary transfer roller 43. Further, the sheet feeding portion 109 includes a pre-fixing feeding belt 44 for sending the sheet S, on which the toner images are transferred, to the fixing device 45. In a downstream side of the fixing device 45, a post-fixing feeding path 59 along which an inner discharging roller pair 46 is provided. Further, the sheet feeding portion 109 includes a reversing portion 85, for feeding the sheet in a switchback manner, provided downstream of the post-fixing feeding path 59 with respect to a (sheet) feeding direction of the sheet S. The post-fixing feeding path 59 and the reversing portion 85 are connected with each other via an exit (first connecting portion) 59*a* of the post-fixing feeding path 59 which is a first horizontal path which extends substantially horizontally.

The reversing portion 85 includes a discharge feeding path 51, a reverse induction path 52, a switchback path 55 and a reverse discharge path 56. The discharge feeding path 51 connecting with the post-fixing feeding path 59 at an upstream end thereof with respect to the feeding direction is a sheet feeding path for guiding the sheet S, on which the image is formed, in order to discharge the sheet S from the image forming apparatus 1. The reverse induction path 52 connecting with the post-fixing feeding path 59 at an upstream and thereof with respect to the feeding direction is a sheet feeding path branching from the post-fixing feeding path 59. The switchback path 55 is a sheet feeding path in which the sheet S passed through the reverse induction path 52 is pulled (drawn) for turning upside down the sheet S and reversing leading and trailing ends of the sheet S with respect to the feeding direction. The reverse discharge path 56 is a sheet feeding path, merged with the discharge feeding path 51, for guiding the sheet S, pulled in the switchback path 55, to be discharged from the image forming apparatus 1. Further, the reversing portion 85 includes an upper reversing roller pair 53 and a lower reversing roller pair 54 which are feeding members provided along the switchback path 55. Further, the reversing portion 85 includes an outer discharging roller pair 49 which is a feeding member for feeding the sheet S discharged from the fixing device 45.

Further, the sheet feeding portion 109 includes a both-side (double-side) feeding path 47 which is a sheet feeding path for feeding the sheet S reversed in feeding direction in the switchback path 55 of the reversing portion 85. The switchback path 55 and the both-side feeding path 47 are connected with each other via an entrance (second connecting portion) 47*a* of the both-side feeding path 47 which is a second horizontal path extending substantially horizontally. The both-side feeding path 47 connects with the supply feeding path 41. Further, the sheet feeding portion 109 includes both surface roller pairs 48*a*-48*d* which are feeding members for feeding the sheet S passing through the both-side feeding path 47.

Further, the image forming apparatus 1 is provided with an operating screen 303. The operating screen 303 not only functions as a display device for displaying information on the image forming apparatus 1 but also functions as an inputting for inputting various setting values into the image forming apparatus 1.

On the other hand, the finisher 80 includes a buffer path unit 181 for feeding the sheet S discharged from the image forming apparatus 1 and a post-processing unit (finisher main assembly) 108 for processing the sheet S fed by the buffer path unit 181. The buffer path unit 181 includes a buffer path 81 which is a sheet feeding path for guiding the sheet S to be fed to the post-processing unit 108. The buffer path 81 is connected with the discharge feeding path 51 of the image forming apparatus 1 in a downstream side with respect to the feeding direction of the sheet S. Further, the finisher 80 includes discharge stacking portions 83*a*-83*d* onto which the sheet S processed by the post-processing unit 108 is discharged. Incidentally, the buffer path unit 181 and the post-processing unit 108 are individual units, and the image forming apparatus 1 may also be connected with the post-processing unit 108 via the buffer path unit 181.

2. Sheet Feeding Process

The sheet S is accommodated in the sheet accommodating portions 30-34 in a stacked manner and is fed by the respective sheet feeding portions 35-39 in synchronism with image forming timing in the image forming portion 102. The sheet S fed by the respective sheet feeding portions 35-39 passes through the respective sheet feeding paths 40, 41 and is fed to the registration roller pair 42.

The fed sheet S is abutted against the registration roller pair 42 and forms a loop thereof. As a result, a leading end of the sheet S follows the registration roller pair 42, so that oblique movement of the sheet S is corrected. Further, the registration roller pair 42 sends, after correcting the oblique movement of the sheet S, the sheet S to the secondary transfer portion N at predetermined timing in synchronism with image forming timing on the sheet S. That is, the registration roller pair 42 feeds the sheet S to the secondary transfer portion N in synchronism with timing when the toner images carried on the intermediary transfer belt 67 which is an image bearing member reaches the secondary transfer portion N.

The secondary transfer portion N is a nip which is formed by the inner secondary transfer roller 70 and the secondary transfer roller 43 disposed opposed to each other via the intermediary transfer belt 67 and where the toner images are to be transferred onto the sheet S. At the secondary transfer portion N, the toner images are transferred (secondary-transferred) onto the sheet S by applying predetermined pressure and a predetermined electrostatic load bias.

3. Image Forming Process

An image forming process carried out at the same timing as the sheet feeding process to the secondary transfer portion N described above will be described. The surface of the rotating photosensitive member 61 is electrically charged uniformly by the charging device 62. The surface of the charged photosensitive member 61 is subjected to scanning exposure by the exposure device 63. The exposure device 63 is driven on the basis of a sent image information signal. As a result, an electrostatic latent image (electrostatic image) is formed on the photosensitive member 61. The electrostatic latent image formed on the photosensitive member 61 is positioned (visualized) with toner as a developer by the developing device 64. As a result, the toner image is formed on the photosensitive member 61. The toner image on the photosensitive member 61 is transferred (primary-transferred) onto the intermediary transfer belt 67 by applying predetermined pressure and a predetermined electrostatic load bias by the primary transfer device 66. Toner (transfer residual toner) remaining on the photosensitive member 61 in a slight amount after a primary transfer step is removed and collected from the surface of the photosensitive member 61 by the photosensitive member cleaner 65.

During formation of a full-color image, the above-described image forming process is performed for each of the colors of yellow (Y), magenta (M), cyan (C) and block (K). Then, the toner images of the respective colors of Y, M, C and K formed on the respective photosensitive members 61 are transferred supposedly onto the intermediary transfer belt 67. As a result, the toner images for the full-color image is formed on the intermediary transfer belt 67.

Incidentally, the image forming apparatus 1 is also capable of forming a monochromatic image of a single color such as black.

4. Processes of Secondary Transfer and Later

As described above, at the secondary transfer portion N, the toner images are transferred (secondary-transferred) from the intermediary transfer belt 67 onto the sheet S. Thereafter, the sheet S is fed to the fixing device 45 by the pre-fixing feeding belt 44. The fixing device 45 fixes (melt-fixes) the toner images on the sheet S by predetermined pressure (urging force) by rollers or belts provided opposed to each other and by heat of a heat source such as a heater.

The sheet S on which the image is fixed is fed in the post-fixing feeding path 59 by the inner discharging roller pair 46 and is fed to the discharge feeding path 51 or the reverse induction path 52. At a branching portion between the discharge feeding path 51 and the reverse induction path 52, a switching device (not shown) for selectively switching the sheet feeding path of the sheet S is provided. When the sheet S is discharged from the image forming apparatus 1, the discharge feeding path 51 is selected. In the case where the sheet S is turned upside down or leading and trailing ends of the sheet S are reversed and the sheet S is discharged from the image forming apparatus 1 or in the case where the image is formed on a second surface in both-surface image formation, the reverse induction path 52 is selected.

The sheet S fed in the discharge feeding path 51 by the inner discharging roller pair 46 is discharged from the image forming apparatus 1 by the outer discharging roller pair 49. With the discharge feeding path 51, the buffer path 81 provided in the buffer path unit 181 of the finisher 80 is connected. The sheet S fed by the outer discharging roller pair 49 is sent to the post-processing unit 108 via the buffer path 81 and is subjected to post-processing by the post-processing unit 108 as desired. Then, finally, the sheet S is discharged onto the discharge stacking portions 83*a*-83*d*.

In the case where the image is formed on the second surface in the both-surface image formation, the sheet S fed in the reverse induction path 52 is pulled into the switchback path 55 by the upper reversing roller pair 53 and the lower reversing roller pair 54. The leading and trailing ends of the sheet S pulled in the switchback path 55 are reversed with respect to the feeding direction by switching a rotational direction of the lower reversing roller pair 54 to an opposite direction to that during the pulling-in of the sheet S (switching operation). Then, the sheet S is fed to the both-side feeding path 47 by the lower reversing roller pair 54. Thereafter, the sheet S is fed in the both-side feeding path 47 by the both-surface roller pairs 48*a*-48*d* and is merged with the feeding path 41 while ensuring timing of a subsequent sheet S fed by the respective sheet feeding members 35-39. Then, the sheet S is fed to the secondary transfer portion N through the registration roller pair 42. As regards the image forming process on the back surface (second surface), the process is the same as that in the according to case of the front surface (first surface) and therefore will be omitted from description.

In the case where the sheet S is discharged from the image forming apparatus 1 after being turned upside down and after the leading and trailing ends of the sheet S are reversed, similarly as in the case where the image is formed on the second surface in the both-surface image formation, the sheet S is pulled from the reverse induction path 52 into the switchback path 55. Thereafter, the rotational direction of the upper reversing roller pair 53 and the lower reversing roller pair 54 is switched to an opposite direction to that during the pulling-in of the sheet S, whereby the sheet S is turned upside down and the leading and trailing ends thereof with respect to the feeding direction are reversed, so that the sheet S is discharged from the switchback path 55. The sheet S is discharged from the image forming apparatus 1 by the outer discharging roller pair 49 via the reverse discharge path 56, and then is sent to the buffer path 81 of the finisher 80 in the same manner as described above.

5. Constitution for Jam Clearance at Reversing Portion

A constitution for removing the sheet stagnating at the reversing portion 85 in the case where a jam generated will be described.

Figure 3:
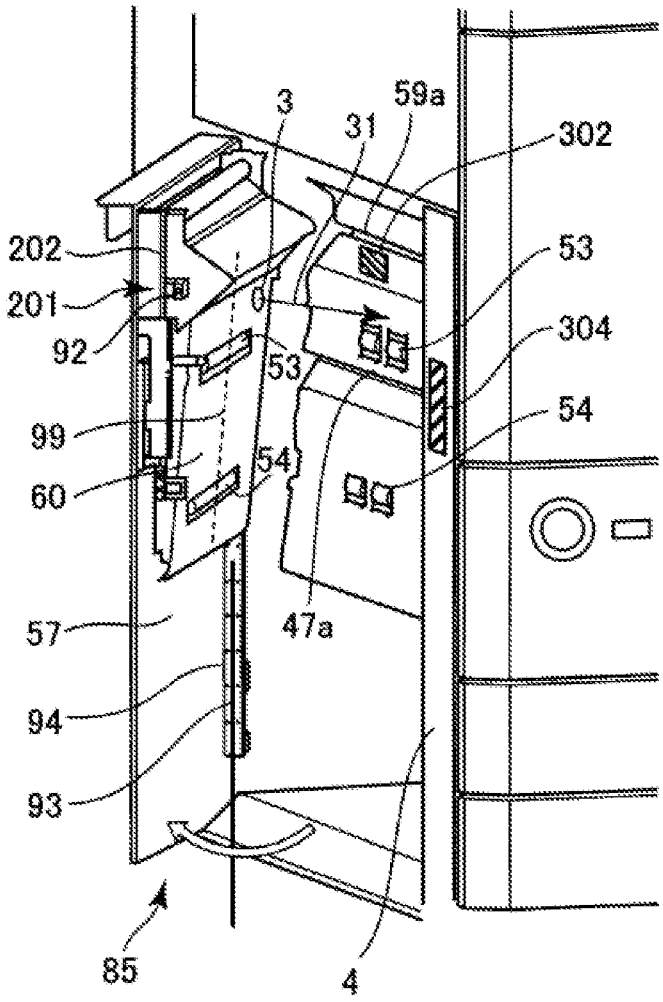
FIG. 3 is a perspective view of a reversing door and a neighborhood thereof.

FIG. 3 is a perspective view of the reversing portion 85 and a neighborhood thereof. In FIG. 3, for easy understanding of a constitution of the reversing portion 85, the finisher 80 is omitted from illustration.

Incidentally, as regards the image forming system 100 (image forming apparatus 1, finisher 80), a front side (surface) on the drawing sheet of FIG. 1 is a "front side (front surface)" and a rear side (surface) on the drawing sheet of FIG. 1 is a "rear side (rear surface)". This front-rear direction is substantially parallel to rotational axis directions of the photosensitive members 61 and the stretching rollers 68-70 for the intermediary transfer belt 67. In the front side of the image forming apparatus 1, the operating screen 303 is provided, and an operator such as a user or a service representative usually carries out an operation of the image forming system 100 from the front side of the image forming apparatus 1. Further, as regards the image forming system 100 (image forming apparatus 1, finisher 80), a left-right direction is a left-right direction when the image forming system 100 is seen from the front side. In general, the image forming system 100 is provided and used so that the front-rear direction is a substantially horizontal direction (substantially perpendicular to a gravitational direction). Further, an up-down direction is an up-down direction with respect to the gravitational direction (vertical direction) but does not mean only right (just) above and right (just) below, but includes an upper side and a lower side with respect to a horizontal surface passing through an objective element or position.

In the left side of the image forming apparatus 1, i.e., at a side surface adjacent to the reversing portion 85, a reversing door 57 as an openable member is provided so that the sheet feeding paths and the feeding members at the reversing portion 85 can be exposed. The reversing door 57 is an example of the openable member for exposing at least a part of the sheet feeding path, for guiding the sheet S in the sheet feeding device 2, to an outside of the image forming apparatus 1. The reversing door 57 is supported by an apparatus main assembly 4 (a frame of the apparatus main assembly 4 in this embodiment) of the image forming apparatus 1 so as to be rotatable by a hinge portion 94 provided in the rear side of the image forming apparatus 1. In this embodiment, the reversing door 57 rotates about a rotation center (rotation axis) 93 disposed so as to extend in a substantially gravitational direction of the hinge portion 94. That is, the reversing door 57 rotates in the substantially horizontal direction about a rotation center 93 positioned in the rear side of the image forming apparatus 1. Thus, typically, the openable member rotates about the rotation center substantially parallel to a flat surface substantially perpendicular to the surface of the sheet fed in the sheet feeding path, and is opened and closed. Particularly, in this embodiment, the openable member rotates about the rotation center disposed along the substantially gravitational direction, and is opened and closed.

The reversing door 57 holds one roller of the upper reversing roller pair 53 and one roller of the lower reversing roller pair 54. An inner surface of the reversing door 57 constitutes a feeding guide surface (guide portion) 60 which forms the switchback path 55 and the reverse induction path 52. Thus, in this embodiment, the sheet feeding device 2 includes, as the sheet feeding path, a first path for discharging the sheet S on which the image is formed by the image forming portion 102. Further, in this embodiment, the sheet feeding device 2 includes, as the sheet feeding path, a second path in which the sheet S is pulled for being turned upside down and for reversing the leading and trailing ends thereof with respect to the feeding direction and which branches from the first path. In this embodiment, the discharge feeding path 51 constitutes the first path. Further, in this embodiment, the reverse induction path 52, the switchback path 55 and the reverse discharge path 56 constitute the second path. Further, in this embodiment, the guide portion 60 of the reversing door 57 as the openable member forms at least a part of the above-described second path.

As shown in FIG. 3, by rotating the reversing door 57 to open, it is possible to not only space the rollers, from each other, constituting each of the upper reversing roller pair 53 and the lower reversing roller pair 54 but also open the reverse induction path 52 and the switchback path 55. Further, thus by rotating the reversing door 57 to open, a state in which the sheet S stagnating in the discharge feeding path 51, the reverse induction path 52, the switchback path 55, the reverse discharge path 56 or the both-side feeding path 47 can be removed (jam clearance) is formed.

The reversing door 57 includes a locking mechanism 201 for locking the reversing door 57 at a closed position. The locking mechanism 201 includes a hook shaft 202 provided rotatably about the reversing door 57, and a hook 92 and a grip 91 (FIG. 4) which are fixed to the hook shaft 202. The hook 92 locks the reversing door 57 at a closed position by being engaged with a positioning pin (not shown) provided on the apparatus main assembly 4. The hook 92 can be disengaged from the positioning pin by rotating the hook shaft 202 in a disengaging direction by operating the grip 91 by the operator. On the other hand, when the reversing door 57 is closed, the hook 92 is automatically engaged with the positioning pin, so that locking is made.

Figure 4:
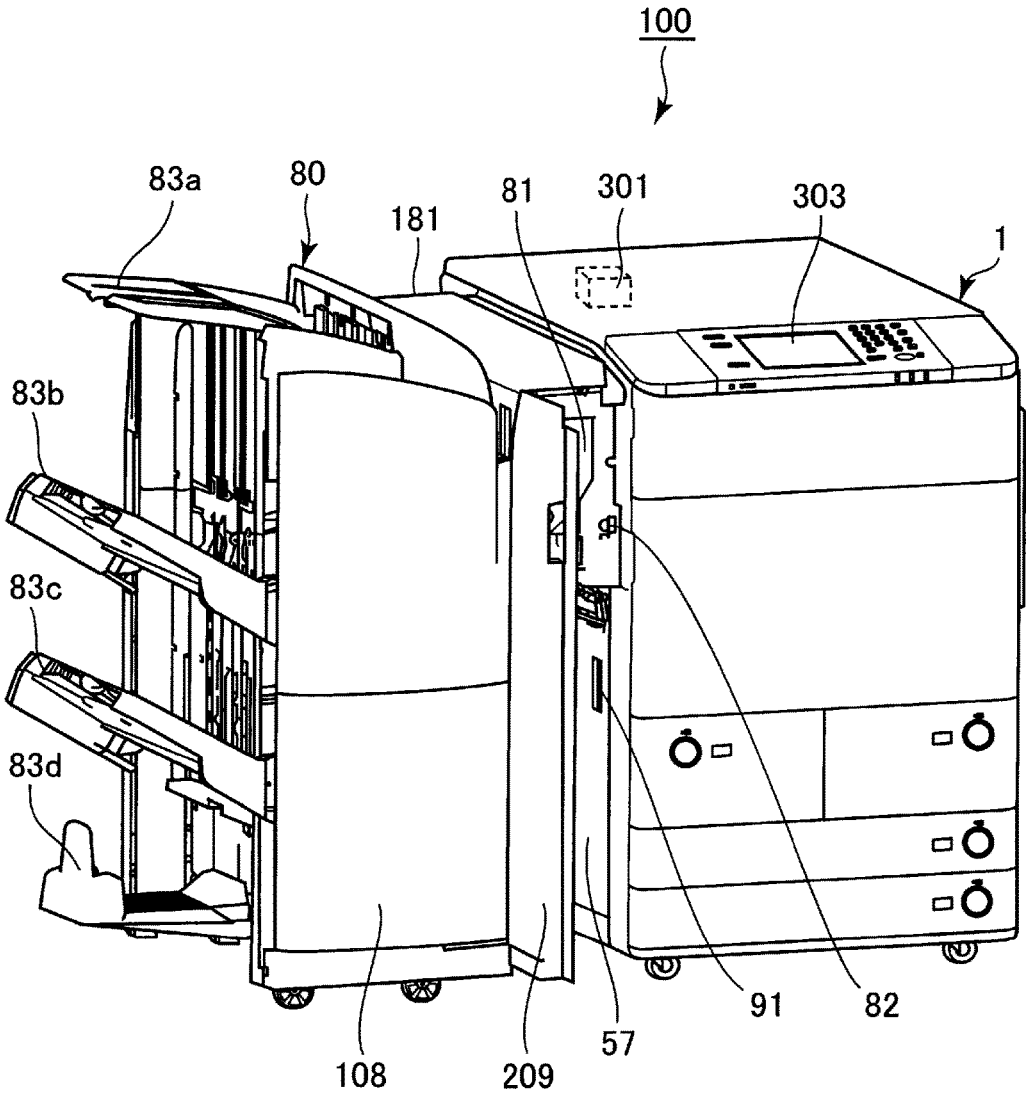
FIG. 4 is a perspective view of the image forming system during an operation of the reversing door.

Here, an opening operation of the reversing door 57 for performing the jam clearance is carried out in a state in which a front-side outer casing 209 provided on the buffer path unit 181 of the finisher 80 as shown in FIG. 4. At this time, at an upper portion of the reversing door 57, the buffer path 81 is disposed, and in the left side of the reversing door 57, the post-processing unit 108 is disposed. The rear side of the buffer path unit 181 is covered with a side plate and an outer casing (which are not shown). Thus, in this embodiment, even in a state in which the finisher 80 is mounted to the image forming apparatus 1, the reversing door 57 is openably maintained. However, the post-processing unit 108 exists in the left side of the reversing door 57, and therefore the opening/closing angle (rotatable angle) of the reversing door 57 is limited to about 30 degrees, so that a space (operation) in which jam clearance is carried out when the reversing door 57 is open becomes narrow. Further, due to existence of elements of the finisher 80 at positions above and in the left side of the reversing door 57, light only enters the open space of the reversing door 57 substantially from the front side.

Figure 5:
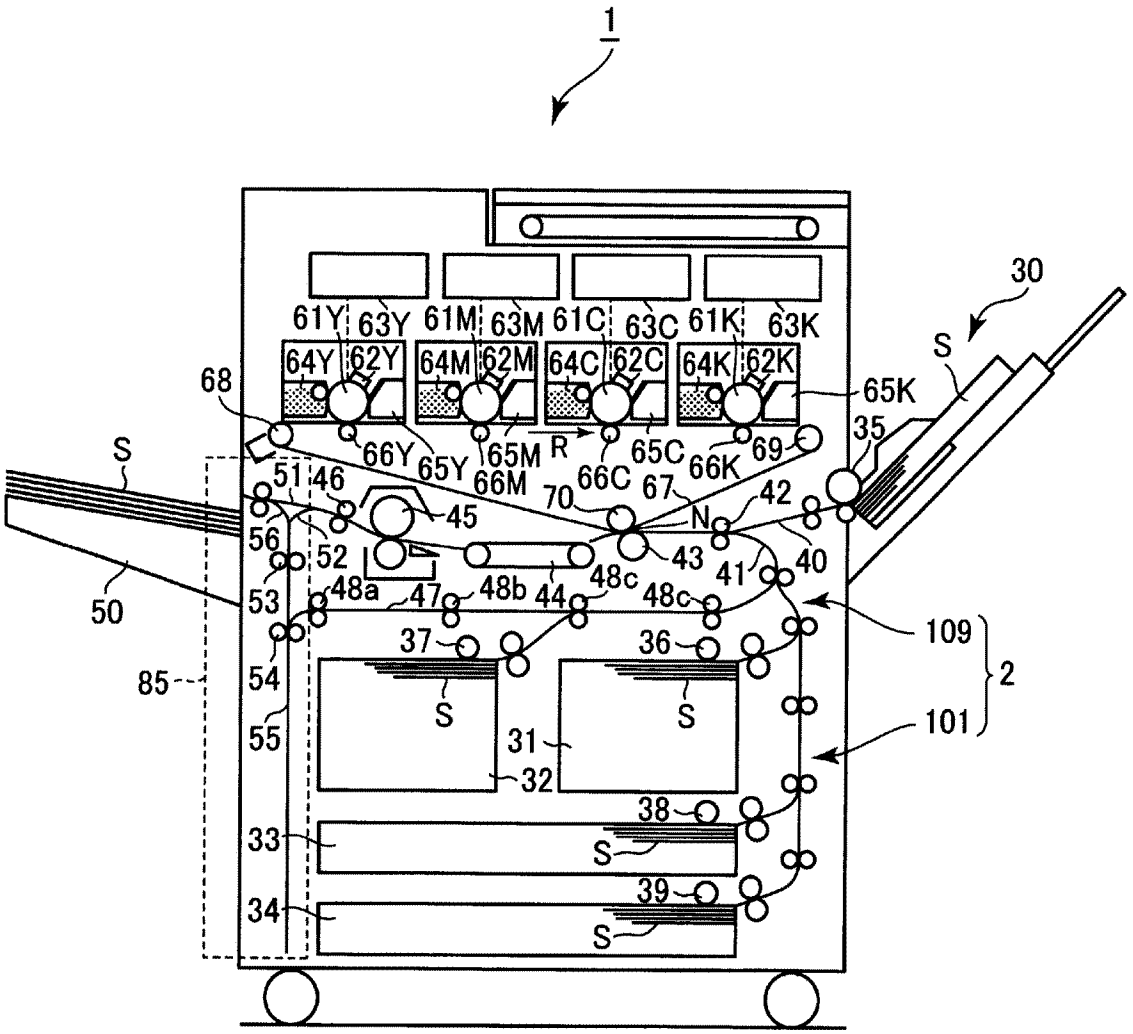
FIG. 5 is a schematic sectional view of an image forming apparatus to which a finisher is not mounted.

On the other hand, as shown in FIG. 5, when the finisher 80 is not mounted to the image forming apparatus 1, the sheet S on which the image is formed is discharged onto a discharge tray 50 provided at a side surface adjacent to the reversing portion 85 of the image forming apparatus 1. In this state, the reversing door 57 can open in the horizontal direction by about 90 degrees. Further, at a periphery of the open space of the reversing door 57, there is substantially no member which blocks the light, and therefore, the open space of the reversing door 57 is adequately lighted.

That is, in this embodiment, the finisher 80 for receiving the sheet S from the sheet feeding device 2 can be arbitrarily mountable to the image forming apparatus 1. Further, the reversing door 57 of the image forming apparatus 1 is openable in a state in which the finisher 80 is mounted to the image forming apparatus 1. Further, when a state of ambient light at a periphery of the image forming system 100 is substantially the same, the reversing door 57 is disposed at a position where the open space when the reversing door 57 is open is darker in a state in which the finisher 80 is mounted to the image forming apparatus 1 than in a state in which the finisher 80 is not mounted to the image forming apparatus 1. Particularly, in this embodiment, the opening/closing angle of the reversing door 57 is smaller in the state in which the finisher 80 is mounted to the image forming apparatus 1 than in the state in which the finisher 80 is not mounted to the image forming apparatus 1.

6. Illumination (Lighting) Device

An illumination (lighting) device for illuminating (lighting) the open space of the reversing door 57 in this embodiment will be described.

As described above, in the state in which the finisher 80 is mounted to the image forming apparatus 1, the opening/closing angle of the reversing door 57 is limited, and only the light from the front side enters the open space of the reversing door 57, and therefore the sheet S stagnating in the sheet feeding path is not readily recognized. That is, in the state in which the finisher 80 is mounted, a periphery of the open space of the reversing door 57 is partly surrounded by the finisher 80 and the reversing door 57, and therefore becomes dark, so that viewability of the sheet S stagnating in the sheet feeding path lowers. As a result, the jam clearance is not readily carried out.

Therefore, in this embodiment, as shown in FIG. 3, the image forming apparatus 1 is provided with an illumination device 3, provided on the reversing door 57, for illuminating at least the sheet feeding path exposed to an outside of the image forming apparatus 1 when the reversing door 57 is open.

Figure 10:
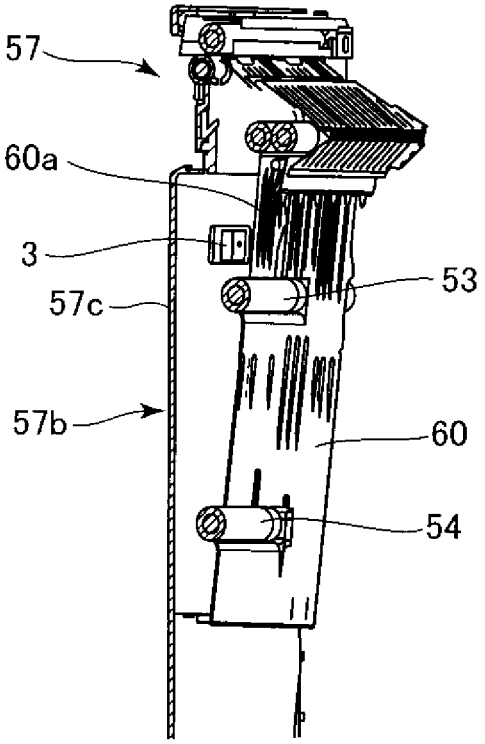
FIG. 10 is a perspective view of the reversing door.

FIG. 10 is a perspective view of the reversing door 57 with respect to the front-rear direction and shows an arrangement of the illumination device 3. In this embodiment, the reversing door 57 includes, as at least a part of the sheet feeding paths, the guide portion 60 forming the reverse induction path 52 and the switchback path 55. Further, a space is formed between the guide portion 60 and a door outer casing 57*b* forming an outer surface of the reversing door 57. In this embodiment, in this space, specifically on a side surface of the door outer casing 57*a* in the guide portion 60 side, the illumination device 3 is disposed. That is, the illumination device 3 is disposed between the guide portion 60 and an outer surface 57*c* of the reversing door 57 facing the outside of the image forming apparatus 1. Thus, by disposing the illumination device 3 inside the guide portion 60, the feeding of the sheet S is not adversely affected. Further, by opening the reversing door 57, the illumination device 3 is not exposed to the open space, and therefore the illumination device 3 does not constitute an obstacle to removal of the stagnating sheet S. Further, the feeding guide (guide portion) 60 is provided with a hole 60*a* for permitting dissipation of water vapor generated by heating the sheet S through the fixing. In this embodiment, this hole 60*a* is used as a light-transmissive portion through which the light of the illumination device 3 passes, and the both-side feeding path 47 and the like are illuminated with the light of the illumination device 3 through the hole 60*a*.

Figure 8:
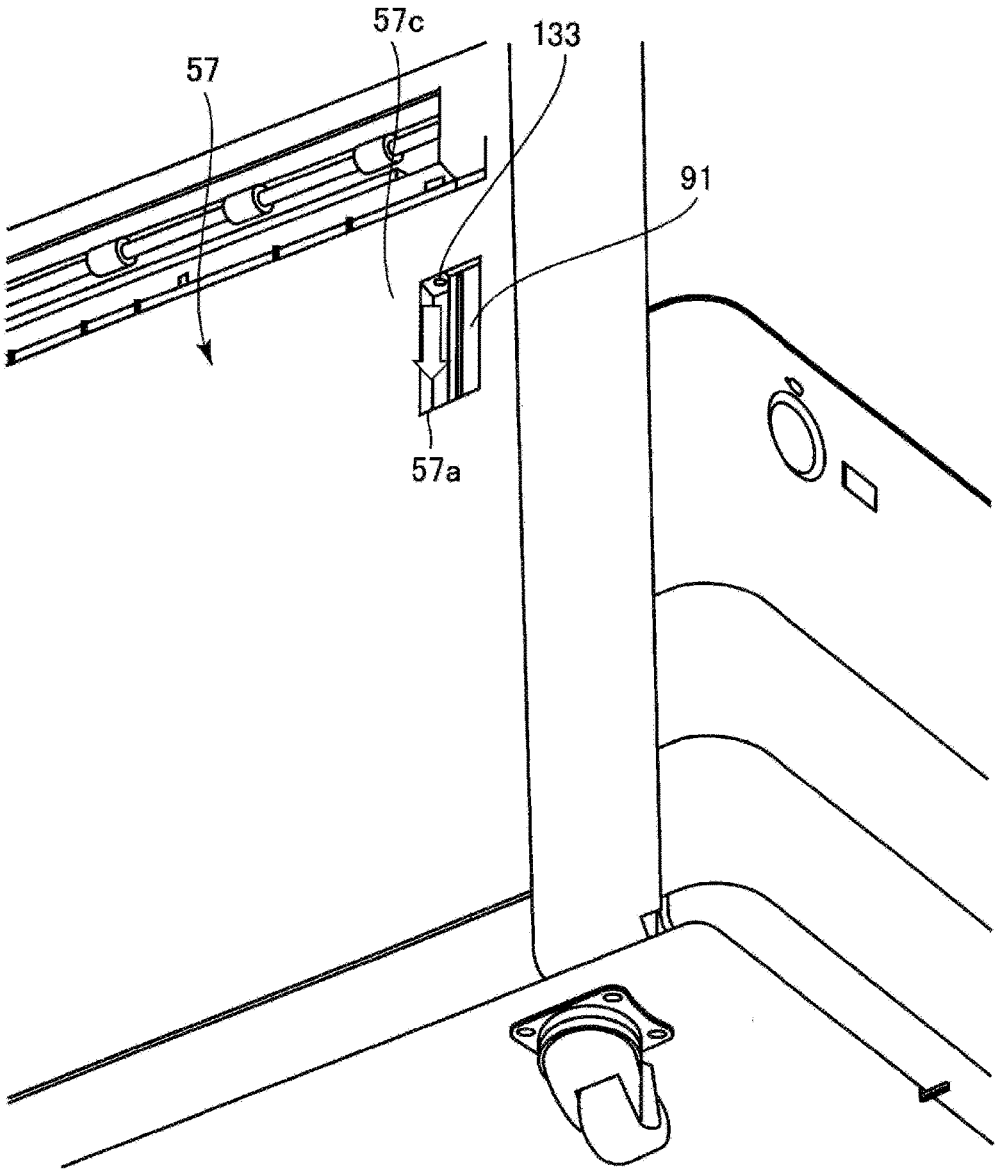
FIG. 8 is a perspective view showing an outer surface of the reversing door.

Further, in this embodiment, as shown in FIG. 8, as a second illumination device for illuminating the outer surface of the reversing door 57 in a state in which the reversing door 57 is closed, a grip illumination device 133 for illuminating a grip 91 is provided. In this embodiment, the grip 91 is provided in a recessed portion provided on the door outer casing 57*b* forming the outer surface of the reversing door 57. Further, in this embodiment, the grip illumination device 133 is disposed above the grip 91 and illuminates the grip 91 by illuminating a space of the recessed portion 57*a* with light of the grip illumination device 133. At this time, the outer surface of the reversing door 57 constituting an inside and outside of the recessed portion 57*a* is illuminated with the light from the grip illumination device 133.

In this embodiment, as regards the illumination device 3 and the grip illumination device 133, as a light source, an LED lighting device using an LED (light-emitting diode) is used. The light source of the illumination device 3 and the grip illumination device 133 is not limited to the LED (lighting device), but may also be an incandescent lamp, a fluorescent lamp or the like. However, from the viewpoints of low electric power consumption, a relatively small size and the like, the LED may preferably be used.

In this embodiment, when the reversing door 57 is open, at least a part of each of the discharge feeding path 51, the reverse induction path 52, the switchback path 55, the reverse discharge path 56 and the both-side feeding path 47 is exposed to the outside of the image forming apparatus 1, so that the operator has access to the respective sheet feeding paths. For that reason, in this embodiment, the illumination device 3 is disposed in the reversing door 57 side so that the sheet S stagnating in the associated sheet feeding path in the apparatus main assembly 4 side is illuminated with the light.

The illumination device 3 provided on the reversing door 57 is turned on and the open space of the reversing door 57 is lighted (illuminated), so that viewability of the sheet S stagnating in the associated sheet feeding path can be improved and thus an operation of the jam clearance can be facilitated.

The reason why the illumination device 3 is provided in the reversing door 57 side is that the sheets S stagnating in a plurality of the sheet feeding paths can be illuminated altogether and compared with a constitution in which the illumination device is provided for each of the sheet feeding paths, provision of the illumination device 3 leads to electric power saving and reduction in number of parts.

In this embodiment, a branching point (meeting point) between the discharge feeding path 51 and the reverse induction path 52, i.e., the exit 59*a* of the post-fixing feeding path 59 in a deep position with respect to a left-side side surface of the apparatus main assembly 4 and is liable to become dark. For that reason, in this embodiment, the illumination device 3 is disposed at the substantially same height as (somewhat below) the branching point so as to adequately illuminate the neighborhood of the branch point. By emitting the light from the position, the light spreads radially, so that it is possible to illuminate also the sheets S stagnating at the entrance 47*a* of the both-side feeding path 47 and in the reverse discharge path 56 with the light.

That is, in this embodiment, the sheet feeding paths (the switchback path 55 and the reverse induction path 52) formed by the guide portion 60 of the reversing door 57 vertically extend. The sheet feeding paths extending vertically and the post-fixing feeding path (first horizontal path) 59 which is the sheet feeding path extending substantially horizontally are connected with each other at the exit (first connecting portion) 59*a* of the post-fixing feeding path 59.

Further, the sheet feeding paths extending vertically and the both-side feeding path (second horizontal path) 47 which is the sheet feeding path extending substantially horizontally are connected with each other at the entrance (second connecting portion) 47*a* of the both-side feeding path 47. Further, as shown in FIG. 3, when the reversing door 57 is opened, the entrance 47*a* of the both-side feeding path 47 and the exit 59*a* of the post-fixing feeding path 59 are exposed. Here, in this embodiment, the position of the illumination device 3 with respect to a height direction is between the entrance 47*a* of the both-side feeding path 47 and the exit 59*a* of the post-fixing feeding path 59. For that reason, the illumination device 3 is capable of effectively illuminate both of the entrance 47*a* of the both-side feeding path 47 and the exit 59*a* of the post-fixing feeding path 59.

Figure 6:
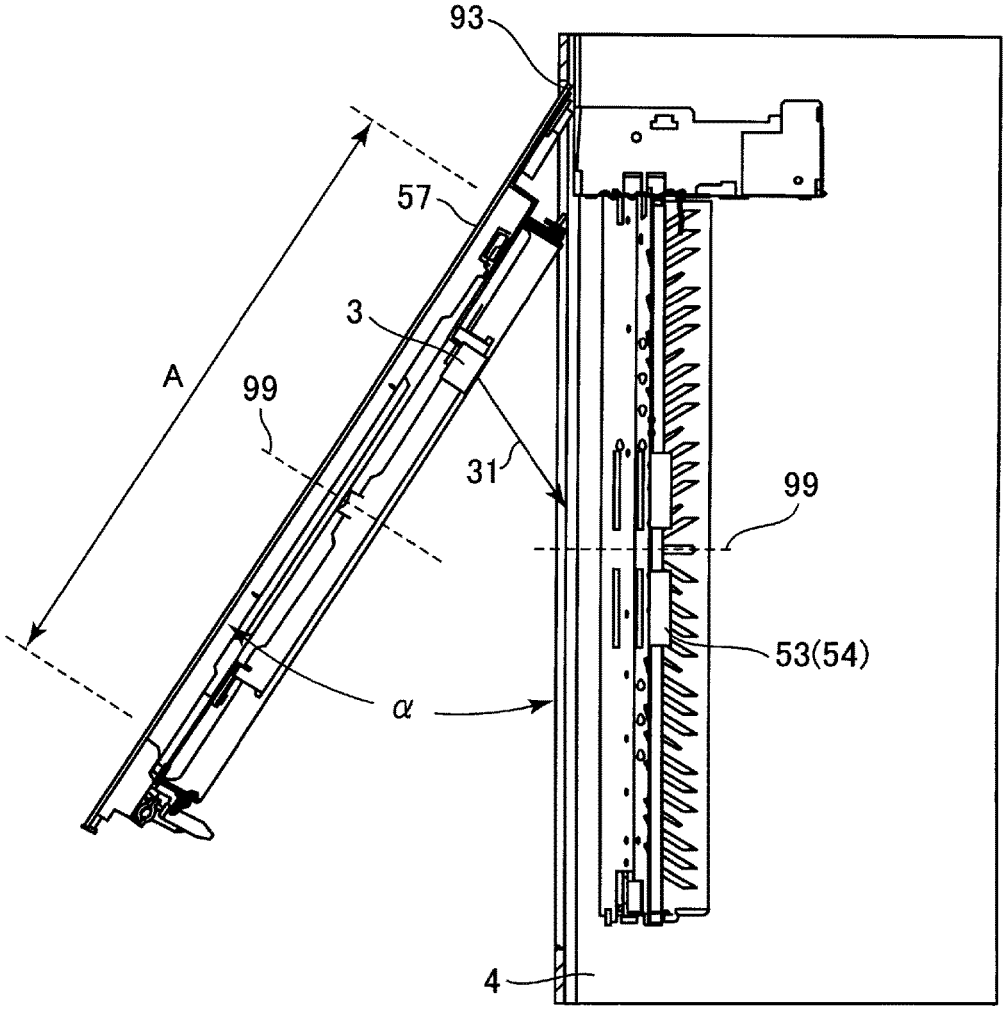
FIG. 6 is a sectional view of the reversing door and the neighborhood thereof.

Further, in this embodiment, the position of the illumination device 3 with respect to the front-rear direction is set as follows. FIG. 6 is a sectional view of the reversing door 57 and a neighborhood thereof, in a state in which the reversing door 57 is open, as seen from above. In this embodiment, with respect to a direction substantially perpendicular to the feeding direction of the sheet S in the image forming apparatus 1, the illumination device 3 is disposed in a side closer to a rotation center 93 of the reversing door 57 than a center (feeding path center) 99 of the sheet feeding path (e.g., the discharge feeding path 51, the switchback path 55) is. That is, in this embodiment, with respect to the direction substantially perpendicular to the feeding direction of the sheet S in the image forming apparatus 1, the illumination device 3 is disposed in the rear side of the image forming apparatus 1 relative to the feeding path center 99. Further, with respect to the front-rear direction (substantially perpendicular to the feeding direction of the sheet S), the illumination device 3 is disposed within a width (A in FIG. 6) of a maximum-sized sheet S. that is, with respect to the direction substantially perpendicular to the feeding direction of the sheet S in the image forming apparatus 1, the illumination device 3 is disposed inside a width of a feeding locus of a recording material S, of recording materials S on which the images can be formed by the image forming apparatus 1, having a maximum width with respect to the same direction. Further, in this embodiment, the illumination device 3 is disposed so that an optical axis (optical path center) 31 thereof extends toward the neighborhood of the feeding path center 99. Specifically, the optical axis 31 of the illumination device 3 extends in the following direction. That is, at this time, the optical axis 31 of the illumination device 3 extends toward the feeding path center 99 or the rotation center side of the reversing door 57 relative to the feeding path center 99.

Thus, by disposing the illumination device 3 is the side closer to the rotation center 93 than the feeding path center 99 is, when the reversing door 57 is opened and the jam clearance is carried out in the open space, it is possible to illuminate the neighborhood of the feeding path center 99 with the light irrespective of an open angle $\alpha$.

In the case where the illumination device 3 is disposed in a side closer to the front side than the feeding path center 99 is, the optical axis 31 of the illumination device 3 moves from the feeding path center 99 toward the front side (front direction) with an increasing open angle $\alpha$ during the opening of the reversing door 57. A deviation amount of the optical axis 31 is larger in this case than in the case where the illumination device 3 is disposed in the side closer to the rotation center 93 than the feeding path center 99. Accordingly, for example, in the case where the open angle $\alpha$ of the reversing door 57 changes by contact with the reversing door 57 during the jam clearance, it would be considered that the optical axis 31 of the illumination device 3 deviates from the sheet S stagnating in the sheet feeding path and operativity lowers.

Further, an entirety of the open space of the reversing door 57 can be more satisfactorily illuminated by the illumination device 3 in the case where the illumination device 3 is in the side closer to the rotation center 93 than the feeding path center 99 is, i.e., in the case where the illumination device 3 is in a position closer to a portion which is liable to become dark. As a result, it is possible to prevent incomplete removal of the sheet stagnating in the sheet feeding path.

7. Sequence of Turning-on of Illumination Device

Figure 7:
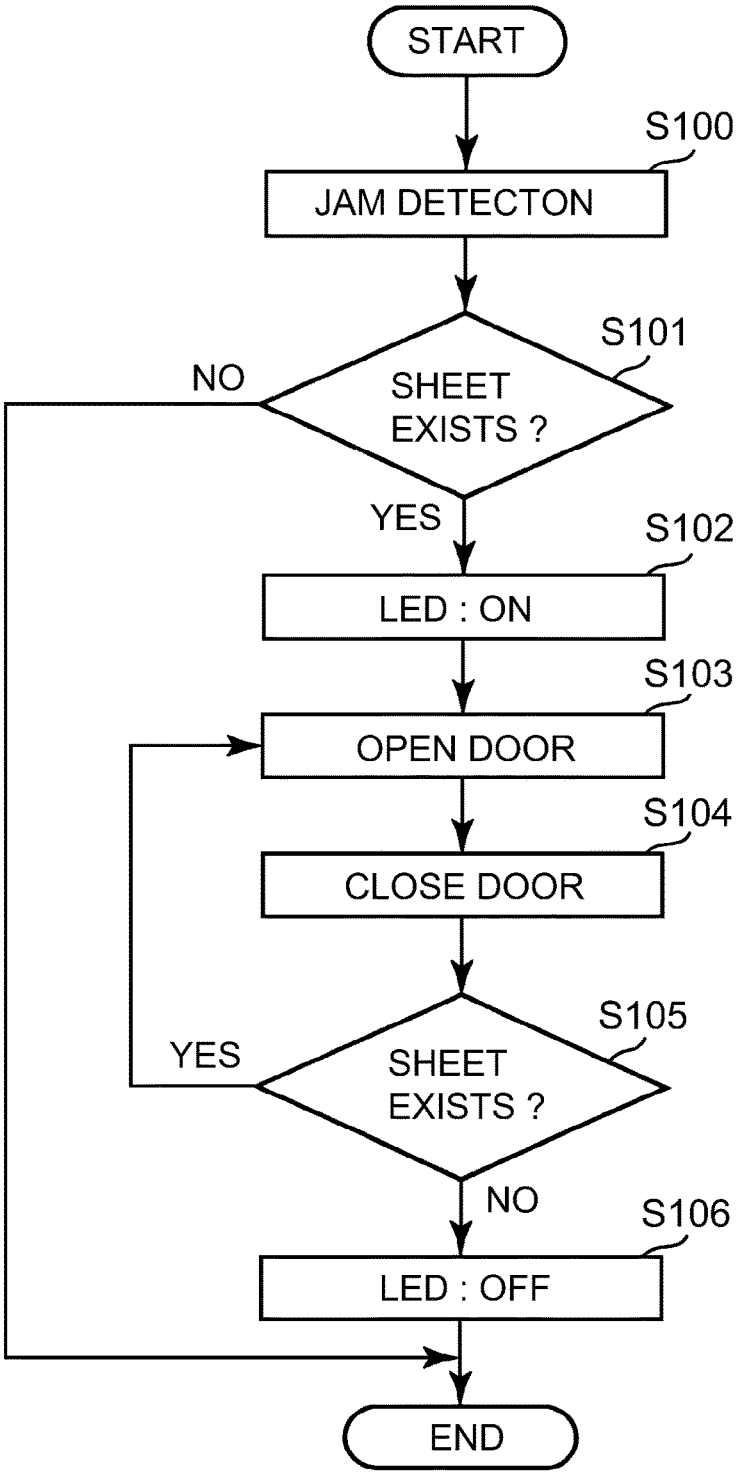
FIG. 7 is a flowchart of an example of control of turning-on and turning-off of an illumination device (lighting device).

A control flow of turning-on and turning-off of the illumination device 3 will be described with reference to FIG. 7. This control is executed by CPU 301 (FIG. 2) as a controller incorporated in the image forming apparatus 1.

First, when a jam detection signal is inputted (S100), the CPU 301 discriminates whether or not the sheet S exists at the reversing portion 85 (S101). The jam detection signal is inputted into the CPU 301 from, for example, a device, monitoring discharge timing of the sheet S, as a jam detecting means. Further, the CPU 301 discriminates the presence or absence of the sheet S at the reversing portion 85 on the basis of an output of a sheet presence/absence sensor 302 (FIG. 3) as a sheet presence/absence detecting means provided at the reversing portion 85. In the case where the CPU 301 discriminated that the sheet S does not exist (present) at the reversing portion 85, the CPU 301 ends a process (sequence) since there is no need to carry out the jam clearance at the reversing portion 85. On the other hand, the CPU 301 discriminated that the sheet S exists at the reversing portion 85, the CPU 301 turns on the illumination device 3 and the grip illumination device 133 (S102) and displays an instruction to open the reversing door 57 on the operating screen 303 (S103). After the jam clearance, when the closing of the reversing door 57 is detected by an opening/closing sensor 304 (FIG. 3) as an opening/closing detecting means provided on the apparatus main assembly 4 (S104), the CPU 301 discriminates the presence or absence of the sheet S at the reversing portion 85 again (S105). Then, when the sheet S is removed, the CPU 301 turns off the illumination device 3 and the grip illumination device 133 (S106) and ends the process.

Figure 9:
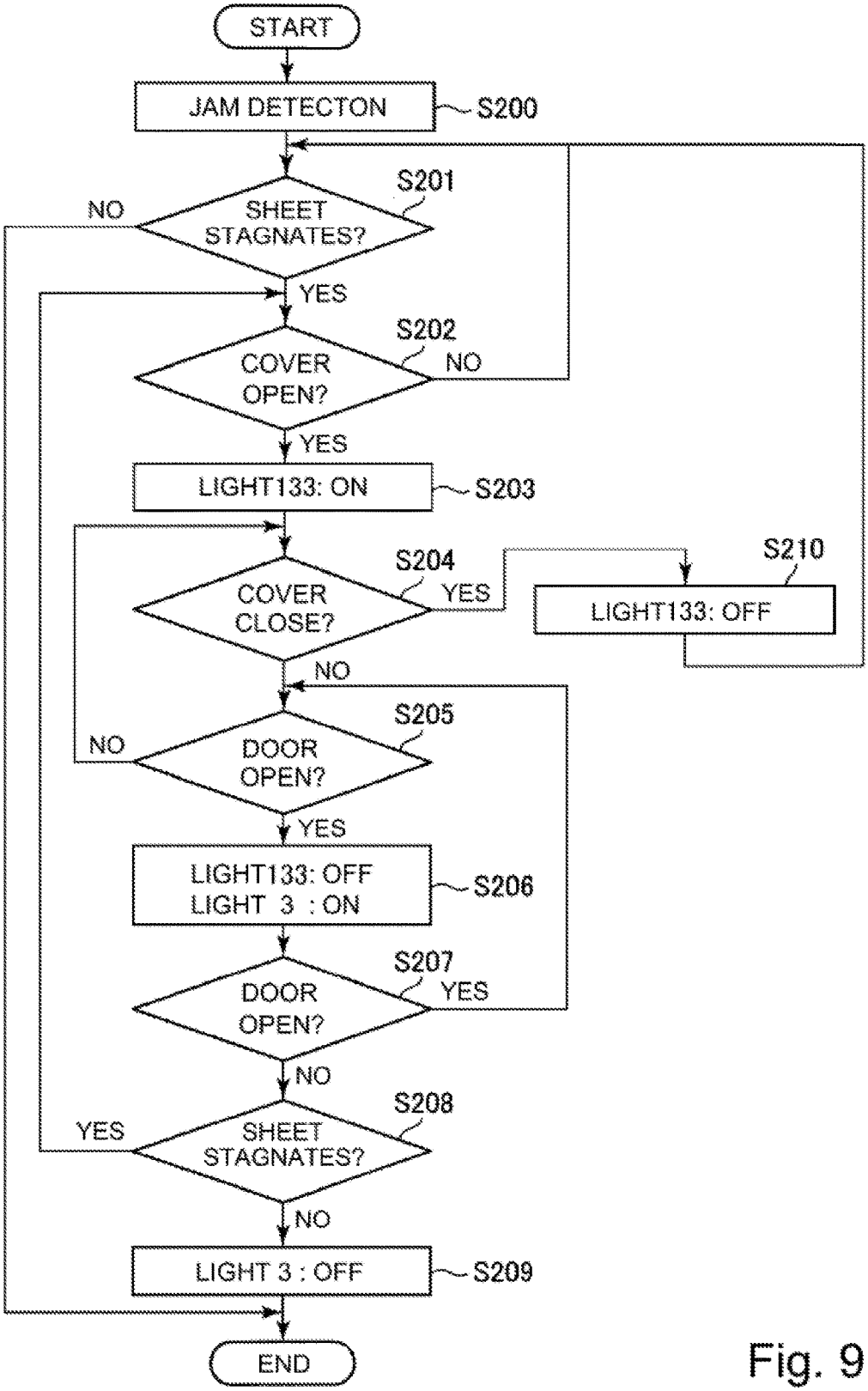
FIG. 9 is a flowchart of another example of the control of turning-on and turning-off of the illumination device.

Further, the control of the turning-on and the timing-off of the illumination device 3 and the grip illumination device 133 may also be carried out as in a modified embodiment, in which only a necessary portion is illuminated with the light. FIG. 9 shows a flow of turning-on control executed by the CPU 301 in the modified embodiment.

When the jam detection signal is inputted (S200), the CPU 301 discriminates whether or not the sheet S stagnates (jams) at the reversing portion 85 (S201), and when the sheet S stagnates (YES of S201), the CPU 301 discriminates whether or not the outer casing 209 is open (S202). Here, opening/closing detection of the outer casing 209 provided to the buffer path unit 181 is carried out by an opening/closing sensor 82 (FIG. 4). Incidentally, until the outer casing 209 is opened, at the operating screen 303, display for prompting the operator to open the outer casing 209 is made. When the outer casing 209 is opened (YES of S202), the CPU 301 turns on the grip illumination device 133 (S203). Thereafter, the CPU 301 discriminates whether or not the outer casing 209 is closed (S204), and when the outer casing 209 is closed (YES of S204), the CPU 301 turns off the grip illumination device 133 (S210), and the sequence goes to a process of S201. On the other hand, when the outer casing 209 is not closed (NO of S204), the CPU 301 discriminates whether or not the reversing door 57 is open (S205). Incidentally, from the opening of the outer casing 209 to the opening of the reversing door 57, at the operating screen 303, display for prompting the operator to open the reversing door 57 is made.

Then, when the reversing door 57 is opened (YES of S205), the CPU 301 turns off the grip illumination device 133 and turns on the illumination device 3 (S206). Then, the CPU 301 discriminates whether or not the reversing door 57 is open (S207), and when the reversing door 57 is closed (NO of S207), the CPU 301 discriminates whether or not the sheet S stagnates at the reversing portion 85 (S208). When the sheet S does not stagnate at the reversing portion 85 (NO of S208), the CPU 301 turns off the illumination device 3 (S209) and ends the process (sequence). On the other hand, when the sheet S stagnates at the reversing portion 85 (YES of S208), the CPU 301 causes the sequence to go to the process of S202, and when the outer casing 209 is open (YES of S202), the CPU 301 turns on the grip illumination device 133 again.

Incidentally, the illumination device 3 and the grip illumination device 133 may also be capable of being manually turned on as desired by a switch separately provided at the operating screen 303 or the like. For example, during periodical cleaning, part exchange or the like, the service representative can arbitrarily turn on the illumination device 3, so that the operation can be performed even when an illumination device or the like is separately prepared.

Further, it is also possible to employ a constitution in which the illumination device 3 and the grip illumination device 133 can be turned on in the case where the finisher 80 is mounted to the image forming apparatus 1 and in which the illumination device 3 is not turned on in the case where the finisher 80 is not mounted to the image forming apparatus 1. In this case, the CPU 301 discriminates the presence or absence of the finisher 80 depending on the presence or absence of communication between itself and the finisher 80, for example, and in the case where the jam detection signal is inputted after the CPU 301 discriminated that the finisher 80 exists (presents), the CPU 301 effects the same processes as those of S101-S106 in FIG. 7. Further, in the case where the jam detection signal is inputted after the CPU 301 discriminated that the finisher 80 does not exist, the CPU 301 may only be required to carry out the same processes as those of S101-S106 except that the turning-on process of the illumination device 3 in S102 and the turning-off process of the illumination device 3 in S106 are not carried out.

As described above, according to this embodiment, the image forming apparatus 1 includes the illumination device 3 for illuminating at least a part of the sheet feeding paths (e.g., the discharge feeding path, the switchback path 55) which is accessible by opening the reversing door 57 opened and closed for the jam clearance. As a result, the open space of the reversing door 57 is illuminated with the light, so that the viewability of the sheet S stagnating in the sheet feeding path can be improved. Further, according to this embodiment, by disposing the illumination device 3 in the neighborhood of the rotation center 93, a degree of the change in illumination position of the illumination device 3 depending on the open angle $\alpha$ of the reversing door 57 is reduced, so that the viewability of the sheet S stagnating in the sheet feeding path can be improved irrespective of the open angle $\alpha$ of the reversing door 57.

Other Embodiments

As described above, the present invention was described based on the specific embodiments, but is not limited to the above-described embodiments.

In the above-described Embodiments, as the light-transmissive portion provided in the guide portion of the reversing door, the hole provided in the guide portion was described, but the light-transmissive portion is not limited thereto. For example, a light-transmissive member to which the light of the illumination device is adequately transparent so as to adequately pass through the light-transmissive member may also be used as the light-transmissive member.

In the above-described Embodiments, the option unit was connected with the side surface of the image forming apparatus from which the sheet is discharged, but the present invention is not limited thereto. For example, it would be considered that a sheet feeding device for feeding the sheet to the image forming apparatus 1 is connected as the option unit so as to be adjacent to a right-side side surface of the image forming apparatus 1 shown in FIG. 1. Also in this case, an openable member, openable maintained even in a state in which the option unit is mounted to the image forming apparatus 1 at the right-side side surface, for exposing, e.g., the sheet feeding paths and the feeding members of the sheet feeding portion 101 in the image forming apparatus 1 is provided in some cases. Also in this case, by applying the present invention to the openable member, it is possible to obtain an effect similar to those in the above-described Embodiments.

Further, in the above-described Embodiments, the case where the openable member provided to the image forming apparatus is opened and closed for the jam clearance was described. For example, in the case where the option unit is connected adjacently to the side surface of the image forming apparatus from which the sheet is discharged, the sheet feeding paths and the feeding members in the neighborhood of the sheet discharging portion become dark, and therefore the present invention is very effective. However, the present invention is not limited to the openable member exclusively used for the jam clearance, but can also be applied to an arbitrary openable member such as an openable member or the like which is opened and closed for exchanging replacement parts of the image forming apparatus and for cleaning an inside of the image forming apparatus and the like purpose.

Further, the illumination device may preferably be provided to the openable member as described above. However, when an object to be illuminated is sufficiently illuminated by the illumination device, the illumination device may also be provided in the apparatus main assembly side of the image forming apparatus or in the option unit side as desired.

That is, the image forming apparatus typically includes the image forming apparatus for forming the image on the sheet and the post-processing device, to which the sheet on which the image is formed by the image forming apparatus and then which is discharged from the image forming apparatus is fed, connected detachably mountable to the image forming apparatus. Further, the image forming system can employ a constitution including the openable member, provided to the image forming apparatus, opened and closed in the space between the image forming apparatus and the post-processing device and the illumination device, provided to the openable member, for illuminating the open space when the openable member is open.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2016-023046 filed on Feb. 9, 2016, and 2016-137176 filed on Jul. 11, 2016, which are hereby incorporated by reference herein in their entirety.

What is claimed is:

1. An image forming apparatus comprising:

a main assembly;

an image forming portion for forming an image on a sheet;

an openable member rotatably supported by said main assembly;

a first feeding guide provided on said openable member;

a second feeding guide provided in said main assembly, wherein when said openable member is closed, a sheet feeding path for feeding the sheet is formed by said first and second feeding guides;

a hole provided in said first feeding guide; and an illumination device, provided on said openable member, for illuminating at least a part of said second feeding guide through said hole when said openable member is open.

2. An image forming apparatus according to claim 1, wherein said illumination device is disposed between said first feeding guide and said openable member.

3. An image forming apparatus according to claim 1, wherein said sheet feeding path includes a discharge feeding path for discharging the sheet on which the image is formed by said image forming portion and a switchback path, branching from said discharge feeding path, in which the sheet is pulled for turning upside down the sheet on which the image is formed by said image forming portion, and wherein said first and second feeding guides form a part of said discharge feeding path and said switchback path.

4. An image forming apparatus according to claim 1, wherein an option unit for receiving the sheet discharged from said sheet feeding path is mountable to said image forming apparatus, and wherein said openable member is openable in a state in which said option unit is mounted to said image forming apparatus, and an open space when said openable member is open is darker in the state in which said option unit is mounted than in a state in which said option unit is not mounted.

5. An image forming apparatus according to claim 4, wherein said illumination device illuminates said sheet feeding path only when said option unit is mounted to said image forming apparatus.

6. An image forming apparatus according to claim 4, wherein said option unit is a decurling unit for correcting a curled state of the sheet on which the image is formed by said image forming portion.

7. An image forming apparatus according to claim 4, wherein said option unit is a binding processing unit for subjecting the sheet, on which the image is formed, to binding processing.

8. An image forming apparatus according to claim 4, wherein an opening/closing angle of said openable member is smaller in the state in which said option unit is mounted to said image forming apparatus than in the state in which said option unit is not mounted.

9. An image forming apparatus according to claim 1, further comprising a hinge portion provided in a rear side of said image forming apparatus, wherein said openable member rotates about a rotation center extending in a substantially gravitational direction of said hinge portion.

10. An image forming apparatus according to claim 9, wherein said illumination device is disposed in a side closer to the rotation center than to a center of said sheet feeding path with respect to a direction substantially perpendicular to a sheet feeding direction in said image forming apparatus.

11. An image forming apparatus according to claim 1, wherein said illumination device illuminates said second feeding guide when a jam of the sheet is detected in said sheet feeding path.

12. An image forming apparatus according to claim 1, wherein said illumination device illuminates said second feeding guide when said openable member is open.

13. An image forming apparatus according to claim 1, wherein said illumination device is disposed within a width of a maximum-sized sheet with respect to a direction substantially perpendicular to a sheet feeding direction.

14. An image forming apparatus according to claim 1, wherein said openable member is provided at a side surface of said image forming apparatus where the sheet is to be discharged.

15. An image forming apparatus according to claim 1, further comprising:

a grip provided on said openable member; and a second illumination device for illuminating said grip in a state in which said openable member is closed.

16. An image forming apparatus according to claim 15, wherein depending on opening of said openable member, said illumination device is turned on and said second illumination device is turned off.

17. An image forming apparatus according to claim 1, further comprising a fixing device for heating and fixing a toner image transferred on the sheet, wherein said hole dissipates water vapor generated by heating the sheet by said fixing device.

18. A sheet feeding device comprising:

a main assembly;

an openable member rotatably supported by said main assembly;

a first feeding guide provided on said openable member;

a second feeding guide provided in said main assembly, wherein when said openable member is closed, a sheet feeding path for feeding the sheet is formed by said first and second feeding guides;

a hole provided in said first feeding guide; and an illumination device, provided on said openable member, for illuminating at least a part of said second feeding guide through said hole when said openable member is open.

* * * * *